US009915013B2

(12) United States Patent
Vanderjeugt et al.

(10) Patent No.: US 9,915,013 B2
(45) Date of Patent: Mar. 13, 2018

(54) SHED FORMING DEVICE FOR A WEAVING MACHINE

(71) Applicant: NV MICHEL VAN DE WIELE, Kortrijk/Marke (BE)

(72) Inventors: Bram Vanderjeugt, Ypres (BE); Matthew Theobald, Whittonstall-northumb (GB); Daniel Skinner, Gosforth-Newcastle-upon-tyne (GB)

(73) Assignee: NV MICHEL VAN DE WIELE, Kortrijk/Marke (BE)

( * ) Notice: Subject to any disclaimer, the term of this patent is extended or adjusted under 35 U.S.C. 154(b) by 0 days.

(21) Appl. No.: 15/327,020

(22) PCT Filed: Jul. 20, 2015

(86) PCT No.: PCT/IB2015/055480
§ 371 (c)(1),
(2) Date: Jan. 17, 2017

(87) PCT Pub. No.: WO2016/009413
PCT Pub. Date: Jan. 21, 2016

(65) Prior Publication Data

US 2017/0167059 A1 Jun. 15, 2017

(30) Foreign Application Priority Data

Jul. 18, 2014 (BE) ..... 2014/0563

(51) Int. Cl.
*D03C 3/20* (2006.01)
*D03C 3/24* (2006.01)
(Continued)

(52) U.S. Cl.
CPC ..... *D03C 3/24* (2013.01); *D03C 3/40* (2013.01); *D03C 3/44* (2013.01)

(58) Field of Classification Search
CPC . D03C 3/20; D03C 13/00; D03C 3/22; D03C 3/00; D03C 3/205; D03C 3/24;
(Continued)

(56) References Cited

U.S. PATENT DOCUMENTS 3,265,096 A * 8/1966 Zangerle ..... D03C 3/20 139/455
3,586,061 A * 6/1971 Lauritsen ..... D03C 3/20 137/884
(Continued)

FOREIGN PATENT DOCUMENTS

DE 10 2005 060163 A1 7/2006
FR 2 811 687 A1 1/2002
NL 7 213 989 A 4/1973

OTHER PUBLICATIONS

International Search Report dated Oct. 26, 2015.
Internation Preliminary Report on Patentability dated Jan. 24, 2017.

*Primary Examiner* — Bobby Muromoto, Jr.
(74) *Attorney, Agent, or Firm* — Symbus Law Group; Clifford D. Hyra

(57) ABSTRACT

A shed forming device for a weaving machine comprising motion systems consisting of hooks that are moveable up and down, transmission elements to transmit the hook motion to a carrier for warp threads, a first force element to exert a downward-directed force on the carrier, and an energy buffer and a second force element to exert a force on an element of the motion system that results in an upward-directed force on the carrier so that the element is so deformed or displaced that the elements of the motion system are kept under tension.

21 Claims, 12 Drawing Sheets

(51) Int. Cl.
*D03C 3/40* (2006.01)
*D03C 3/44* (2006.01)
*D03D 13/00* (2006.01)

(58) Field of Classification Search
CPC ... D03C 1/00; D03C 3/12; D03C 3/26; D03C 5/00; D03D 41/00
See application file for complete search history.

(56) References Cited

U.S. PATENT DOCUMENTS 3,724,511 A * 4/1973 Kleiner ..... D03C 1/00 139/331
3,828,826 A * 8/1974 Hurzeler ..... D03C 3/20 139/59
4,195,671 A * 4/1980 Bossut ..... D03C 3/00 139/455
4,326,563 A * 4/1982 Brock ..... D03C 5/02 139/76
4,367,770 A * 1/1983 Schwarz ..... D03C 1/00 139/66 R
4,481,979 A * 11/1984 Mizuguchi ..... D03C 13/00 139/82
4,572,247 A * 2/1986 Speich ..... D03C 13/00 139/319
4,593,723 A * 6/1986 Griffith ..... D03C 3/20 139/455
4,730,641 A * 3/1988 Schwarz ..... F16D 11/16 139/76
4,858,654 A * 8/1989 Derudder ..... D03C 3/12 139/455
4,936,357 A * 6/1990 Keim ..... D03C 3/20 139/455
5,095,952 A * 3/1992 Cheng ..... D03C 3/20 139/455
5,145,263 A * 9/1992 Yokoi ..... F16C 9/04 384/219
5,257,649 A * 11/1993 Froment ..... D03C 3/26 139/59
5,392,820 A * 2/1995 Seiler ..... D03C 3/20 139/455
5,464,046 A * 11/1995 McIntyre ..... D03C 3/20 139/455
5,647,403 A * 7/1997 Willbanks ..... D03C 3/20 139/455
5,839,481 A * 11/1998 Bassi ..... D03C 3/24 139/455
6,092,564 A * 7/2000 Bourgeaux ..... D03C 3/20 139/455
6,382,263 B2 * 5/2002 Dewispelaere ..... D03C 3/24 139/455
7,057,329 B2 * 6/2006 Barth ..... D03C 3/20 139/455
7,320,343 B2 * 1/2008 Speich ..... D03C 3/10 139/110
7,658,209 B2 * 2/2010 Debaes ..... D03C 1/00 139/21
7,806,149 B2 * 10/2010 Borer ..... D03C 1/00 139/455
2006/0169345 A1 * 8/2006 Speich ..... D03C 3/10 139/55.1
2007/0107796 A1 * 5/2007 Nayfeh ..... D03C 13/00 139/11
2009/0277529 A1 * 11/2009 Borer ..... D03C 1/00 139/455

* cited by examiner

SHED FORMING DEVICE FOR A WEAVING MACHINE

This invention relates to a shed forming device for a weaving machine comprising a number of motion systems consisting of a plurality of elements, each comprising: at least one carrier that is movable up and down by a driving element to position one or more warp threads in a shed, and transmission elements for transmitting the motion of each driving element to a carrier, wherein each motion system comprises a first force element that is connected on the one hand to the carrier and on the other hand to a fixed point in order to exert a downward-directed first force on the carrier, and wherein each motion system comprises a second force element and an energy buffer.

The term 'force element' is used in this patent application as meaning an element in which potential, hydraulic or pneumatic energy can be built up. Hence an element that from itself through its own energy state is able to 'exert' a force on another element or on a part of a motion system.

During weaving on a weaving machine, consecutive weaving cycles are performed during each of which one or more weft threads are inserted into a shed between warp threads. During this shed formation and during each weaving cycle, the different warp threads must be positioned relative to each level at which a weft thread is inserted in such a way that the warp threads have a passage relative to the following weft threads, and such that a fabric with the desired structure and with the desired design or pattern is obtained.

The shed formation can be effected on a weaving machine using a known jacquard device with sets of two knives which are reciprocally driven in anti-phase in an up-and-down motion, and a series of motion systems, each comprising two interacting hooks. Each of these two hooks can be either moved by a particular knife from a set of knives, or can be selected so that the hook is held at a fixed height. The motion of the two interacting hooks are transmitted in each motion system by means of a pulley element and pulley cords to one or more harness cords that are connected to a respective heddle which comprises a heddle eyelet. By appropriate selection or non-selection of one or both hooks, the heddle eyelet of choice can be brought into one of a number of possible different positions. As a result, each warp thread extending through the heddle eyelet can be correctly positioned in each weaving cycle.

In order to guarantee correct positioning of the heddle eyelet, the heddle is connected to one end of a return spring whose other end is connected to a fixed point of the device that is at a lower level. A permanent downward force is thus exerted on the heddle eyelet. If the heddle has to be brought from a higher position to a lower position, frictional forces acting on the transmission elements oppose this downward motion, so that an additional force is required to guarantee this motion. The return spring and the pretensioning force exerted on it are dimensioned and pretensioned such that the resulting downward force exerted is sufficient to move the heddle quickly and reliably to the lower position under normal working conditions.

During the operation of the shed forming device, however, it is possible that the return spring cannot or cannot fully exert the intended downward force. This can be the case, for example, when the return spring is blocked, for example due to dust deposits, so that it can no longer function over its full length. Also after the upward motion of the hooks, a tension peak in the return spring can be followed by a drop in tension, so that the downward force exerted by the return spring becomes very low or even practically zero for a short time. As a result there can be moments at which the tension in the motion system is very low or disappears. As a result, the vertical parts of the pulley cords and the harness cords are no longer kept properly taut, there is a possibility of an undesirable interaction with adjacent parts and of hooks resting on a moving knife bouncing out of this carrying position. This all leads to a reduction in the operating reliability of the shed forming device with, among other things, inaccurate or incorrect positioning of the warp threads.

U.S. Pat. No. 5,010,927 describes a shed forming device that in addition to the classic return spring comprises an additional spring element that exerts a downward force on the cord that is connected to the hook in order to ensure that the hook is pulled downwards during the operation of the shed forming device. The additional downward force on the hook, however, cannot offer a solution to the problems resulting from a diminished function of the return spring. The elements of the motion system that are below the point of contact of the additional downward force will certainly not be kept under tension by this. The vertical cord parts will not be kept taut. Furthermore, the additional downward force on the hooks creates an additional load on the knives with which the hooks are moved, leading to an increase in the energy consumption of the device. A further disadvantage is that the size of the additional downward force is dependent on the position of the hook, and that the additional spring element has to be able to follow the whole motion of the heddle and is therefore very voluminous as a result.

The object of this invention is to provide a shed forming device with the characteristics indicated in the first paragraph of this description, but in which the problems described above are avoided even if the downward force exerted by the return spring is very greatly diminished or is lost completely, with a minimal increase in the load on the shed forming device and forces that are independent of the position of the driving elements.

This object is achieved if, according to this invention, the first force exerted by the first force element brings about the build-up of a supply of energy in the energy buffer by deformation or displacement of at least one part of an element of the motion system, wherein each motion system comprises stopping means to prevent the displacement or deformation caused by the first force from exceeding a predetermined maximum, and wherein the second force element is provided to transform the energy stored in the energy buffer into a tensioning force that is exerted on an element of the motion system and results in an upward-directed second force on the carrier, wherein at least one part of the latter element is so deformable or displaceable under the influence of the tensioning force that the elements of the motion system are kept under tension.

Because the tensioning force is a force resulting in an upward force on the carrier, this force should also be able to keep the elements of the motion system located between the point of contact of the force and the carrier under tension in situations where the downward first force on the carrier does not or does not sufficiently do this. Furthermore, this force also ensures that all the elements of the motion system are kept under tension by displacing or deforming at least one part of an element of the motion system.

The tensioning force exerted by the second force element is independent of the position of the driving elements and may be far smaller than the downward force that the first force element exerts, so that this second force element ensures only a very small or even no additional load on the driving means of the shed forming device. The disadvantages of the prior art described above are effectively overcome in this way.

The motion system can be developed such that this deformation or displacement and the corresponding build-up of the supply of energy reaches its maximum under normal operating conditions. Normal operating conditions are to be understood here in particular as meaning that the first force element exerts the intended first force on the carrier. Under these conditions, the maximally deformed or displaced part or element should be prevented from being displaced or deformed by more than this maximum by the stopping means, wherein the different elements and parts of the motion system can have a fixed relative position to one another in the motion system and can transmit the motion of the hooks to the carrier in a stable and predictable manner. In this way the correctness of the positioning of warp threads in the shed forming is not negatively influenced by the presence in the motion system of elements or parts thereof which are displaceable or deformable.

If the first force exerted by the first force element on the carrier is lost or becomes smaller than the upward second force on the carrier, the tensioning force should ensure said displacement or deformation so that the elements of the anchoring system remain under tension. As a result, the flexible elements of the motion system (such as i.a. pulley cords and harness cords) extending according to the direction of motion of the hooks should remain taut.

The first force element is preferably provided such that it exerts a downward tractive force on the carrier or on an element of the motion system connected to the carrier. In one particular embodiment, the first force element is thereby located under the carrier. In a very preferential embodiment, the first force element is or comprises an elastically deformable element.

The first force element is preferably located at the outermost point of the motion system while the second force element is located between the first force element and the driving elements. If, under certain (undesirable) operating conditions, the first force element (temporarily) exerts a reduced tractive force, the second force element ensures that the motion system is still subjected to a force that keeps the system taut. The above-mentioned operating conditions can occur, for example, if the return spring itself fails and can no longer develop sufficient force, but also if blocking occurs in the motion system between the first and the second force element, or if the inertia of the system results in the tension of the return spring not being transmitted (for example, in the event of collisions or vibrations).

We emphasize that the terms 'up' and 'down' and 'upward' and 'downward' do not limit the invention to a shed forming device in which the carrier is moved 'vertically' up and down, and in which the carrier is subjected to forces directed 'vertically upwards' and 'vertically downwards'.

Even in a shed forming device in which the carrier is movable on an inclined surface, the carrier moves between an uppermost and a lowermost position and therefore moves up and down. The forces exerted on a carrier that are directed diagonally upwards and diagonally downwards on such an inclined motion plane must therefore also be regarded as forces directed upwards and downwards.

In a shed forming device in which the motion takes place on a completely horizontal surface, the terms 'up' and 'down' must be interpreted as 'in the direction of the driving element, as seen from the carrier' and 'in the direction of the carrier, as seen from the driving element', respectively. The term 'vertically upward force' is then translated as a force acting in the direction of the driving element, as seen from the carrier, and the term 'vertically downward force' is a force acting in the direction of the carrier, as seen from the driving element.

The driving elements preferably work together with hooks in order to transmit the motion to the carrier. These hooks are, for example, selectively moved up and down by driving elements moving up and down. In an alternative embodiment, however, a motion system can also interact with a rotatable driving element provided to selectively wind and unwind a flexible element (e.g. a cord) of the motion system in order to move the carrier to the desired position.

The driving element can, for example, be a drum on which a number of consecutive windings of a cord lie, for example a pulley cord. In this case the second force element ensures that no winding of the cord leaves the drum unintentionally or is wound on top of another winding as a result of the loss of tension in the elements of the motion system in order to prevent inaccurate positioning of the carrier.

If the motion system contains flexible elements (such as cords, etc.) or slightly elastic elements, then one object of this invention is to keep the vertical parts of these elements taut. The expression 'keep under tension' is therefore used on the one hand in the sense of 'keep taut' and said 'tensioning force' is consequently to be interpreted as a force provided to establish this taut state.

Under certain circumstances the tension in the motion system can be very small or even practically zero. We emphasize that 'the keeping taut' of the vertical parts of flexible or elastic elements of the motion system should be interpreted as 'keeping under tension' of these elements even with a very small or completely lost tension.

We emphasize also that shed forming devices with a motion system without flexible or slightly elastic elements are not excluded by the above and fall within the scope of the invention defined in the claims. According to the invention, even a non-flexible or relatively non-elastic element of the motion system can be kept under tension.

As mentioned above, the tensioning force results in a displacement or deformation of an element, or of a part thereof, such that the elements of the motion system located between said element or part thereof and the carrier are kept under tension. It is clear, however, that this is not the case if a local blockage occurs at a certain point in the motion system so that the displacement or deformation of the element in the vertical direction is impossible or limited. Then the part of the motion system between the point of blockage and the carrier can naturally not be kept under tension, and only the part of the motion system located between the point of blockage and said driving element can be kept under tension.

Said displacement or deformation can result in a displacement of an anchoring point and/or in a reduction in the height that the motion system bridges between the driving elements (the knives) and the carrier (the heddle eyelet), as will be explained in greater detail below by reference to various examples.

The tensioning force can deform a part of an elastic element of the motion system so that this part is in a non-taut state, while another element is provided parallel to the non-taut part and bridges the non-taut part in order to transmit the forces and motion into the motion system. The elastic element can, for example, be a cord and the bridging element can, for example, be the force element itself as will be illustrated by reference to the attached drawing. We should emphasize here already that such a non-taut part of an element is placed outside the motion system as it were by the bridging element and does not prevent all the other elements and the parts of the elastic element that at that moment form part of the motion system being kept under tension and taut.

In a preferred embodiment of the inventive shed forming device, each motion system comprises at least one hook that is movable up and down by a driving element, at least one carrier to position one or more warp threads in a shed, and transmission elements to transmit the motion of each hook to at least one carrier.

The second force element preferably is or comprises an energy buffer and the first force exerted by the first force element results in a force on the second force element that brings about the build-up of a supply of energy in the energy buffer.

The energy buffer is preferably an accumulator of potential energy, hydraulic energy or pneumatic energy. The energy buffer can be provided, for example, to store potential energy in the form of elastic energy or gravitation energy.

In a most preferable embodiment said supply of energy can be built up by simple elastic deformation of a spring element. In a possible embodiment the first force element, for example a return spring, that is, for example, a spiral spring, can under normal operating conditions exert a first force which deforms the spring element up to a predetermined maximum deformation. The elastic energy built up in the deformed spring element is then said supply of energy. This energy is converted into a tensioning force in the form of a return spring force that is related to said maximum deformation. If the first force exerted by the first force element temporarily becomes less that the maximum return spring force, this return spring force ensures the spring-back of the spring element so that the drop in tension in the motion system is at least partly offset.

In a preferred embodiment of this shed forming device, at least one element of each motion system is a tensioning element with a first and a second tensioning part that are displaceable relative to one another, and the second force element is provided to exert said tensioning force on at least one of these tensioning parts so that these tensioning parts are forced into a relative position in which the elements of the motion system are kept under tension.

The tensioning parts are hereby integrated into the motion system in such a way, for example, that the tensioning parts are forced into a first relative position by the tensioning force so that the elements of the motion system are kept under tension.

The relative position is hereby the determining factor, for example, for the difference in height between a carrier and a driving element of the motion system that is bridged by the motion system, and the tensioning parts are forced by the tensioning force into a first relative position corresponding to a minimum difference in height so that the elements of the motion system are kept under tension by a reduction in said difference in height.

The first and the second force element are preferably dimensioned such that the first force exerted by the first force element results in a force on at least one of the tensioning parts that moves these tensioning parts against the tensioning force into a second relative position. The second relative position preferably corresponds to a larger difference in height than the first relative position.

The first force exerted by the first force element is preferably much larger than the opposite second force that is the result of the tensioning force exerted by the second force element.

Thereby, it is preferably such that the displacement of the tensioning parts from the first relative position to the second relative position brings about the build-up of a supply of energy in the energy buffer.

In a very preferred embodiment the second force element comprises a spring element that is provided such that the displacement of the tensioning parts from the first relative position to a second relative position brings about an elastic deformation of the spring element. In a specific embodiment the second force element is a spring element, preferably a spiral spring. This can be both a pressure spring and a tension spring.

Each motion system also comprises stopping means to prevent the tensioning parts from being displaced by more than a predetermined second relative position under the influence of the first force. The motion system can be designed such that under normal operating conditions (i.e. when the first force element exerts the requisite first force), the tensioning parts are moved to the second relative position by the first force. The tensioning element can then function in this situation as a stable transmission element to transmit the motion of the driving elements in a predictable manner to the carrier, and hence to correctly position the warp threads in the shed.

If the first force temporarily becomes less that the maximum return spring force, this tensioning force should ensures said displacement or deformation so that the drop in tension in the motion system is at least partly offset. As a result, the flexible elements of the motion system (such as i.a. pulley cords and harness cords) extending according to the direction of motion of the hooks, for example, should remain taut.

In a first special embodiment the tensioning element is a cord of the motion system, wherein a first cord section and a second cord section are at a distance from one another, above and below an intermediate cord section, respectively, and the second force element exerts a tensioning force on one or both cord sections so that the first and second cord sections are forced towards one another.

The motion system preferably comprises at least one pulley over which a pulley cord runs to transmit the motion of the driving element, possibly via hooks, to the harness cord and the tensioning element is a pulley cord.

Furthermore, the second force element can also be provided to keep the intermediate cord section taut so that this intermediate cord section in the taut state acts as a stopping means to prevent any further increase in the distance between said cord sections.

In a second special embodiment of the inventive shed forming device, the tensioning element is a connector with two connector parts that form said tensioning parts and the two connector parts are connected to a respective element of the motion system or to an element of the motion system and a fixed machine part, respectively.

One connector part preferably comprises a head piece that is located displaceably in a locating space of the other connector part.

In a third special embodiment of the inventive shed forming device, each motion system comprises at least one pulley element with two pulleys positioned above one another to transmit the motion of the driving element to at least one harness cord, and the pulley element comprises two pulley parts that are displaceable relative to one another so that the pulley element forms the tensioning element and the two pulley parts form said tensioning parts.

An uppermost and a lowermost pulley cord respectively preferably run over the two pulleys positioned above one another, with the two ends of the uppermost pulley cord being displaceable by means of a respective driving element (I),(II), the lowermost pulley cord is connected to one or more harness cords, and the pulley element acts as a tensioning element in that the pulley element has an uppermost and a lowermost pulley part at a distance apart wherein the pulley parts are displaceable relative to one another and the second force element exerts a force on these pulley parts to reduce said distance.

In a fourth special embodiment the tensioning element is a hook drivable by a driving element with two hook sections that are displaceable relative to one another which form the tensioning parts.

In a preferred embodiment the second force element is a tension spring element that exerts a tractive force on said tensioning parts of the tensioning element to pull these tensioning parts together, or a pressure spring element that exerts a compressive force on one of said tensioning parts to force this tensioning part in the direction of the other tensioning part.

The second force element is preferably provided to permanently exert a tensioning force as soon as the first force element has built up energy in the energy buffer.

The second force element is preferably located in the motion system between the carrier and the driving element. In an advantageous embodiment, the first force element is located at the outermost point of the motion system, preferably between the carrier and a fixed point, and the second force element is located in the motion system between the driving elements and the first force element. The first and the second force element can be located above and below the carrier, respectively, to exert a downward force or an upward force, respectively, on the carrier.

In a possible embodiment, two or more or the above-mentioned special embodiments can be combined in the same motion system. Other elements of the motion system can naturally also be designed as tensioning element.

In order to further illustrate the characteristics of the invention, a detailed description is given below of a number of preferred embodiments of the inventive shed forming device. It should be clear that these are only examples of the many possible embodiments covered by the invention, and that this description can in no way be regarded as a limitation of the scope of the protection. In this detailed description, reference numbers are used to refer to the attached figures, wherein FIG. 1 is a schematic representation of a motion system of a jacquard device according to the invention;

Figure 6A:
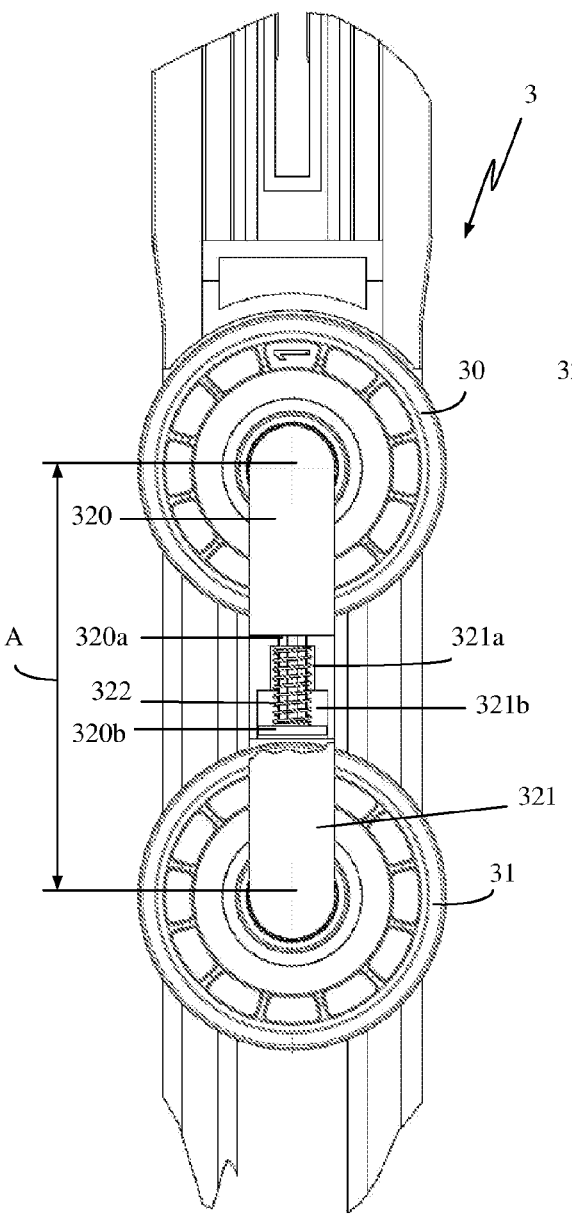
Figure 6B:
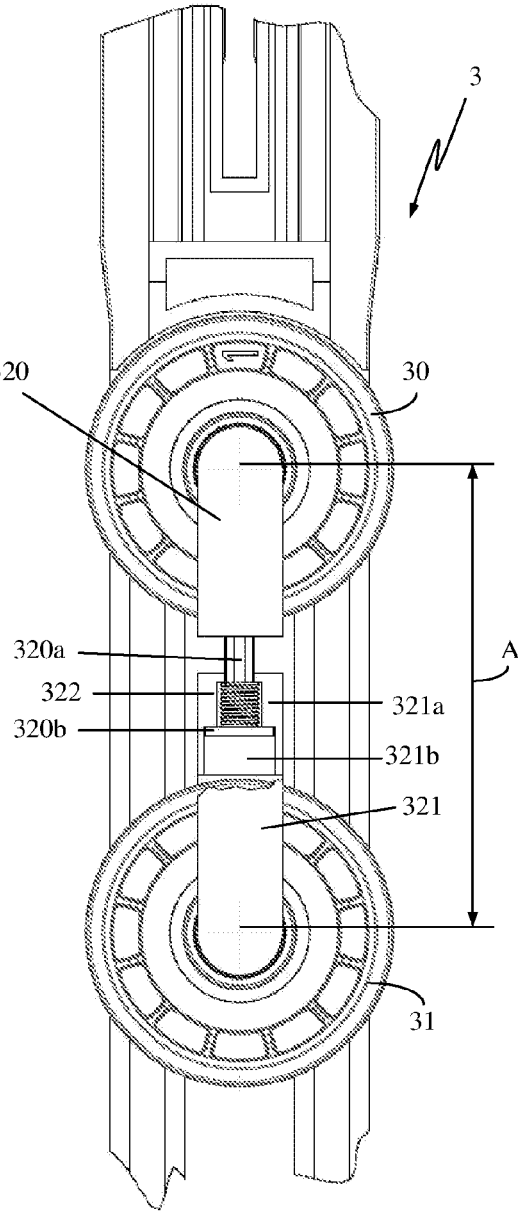
Figure 7A:
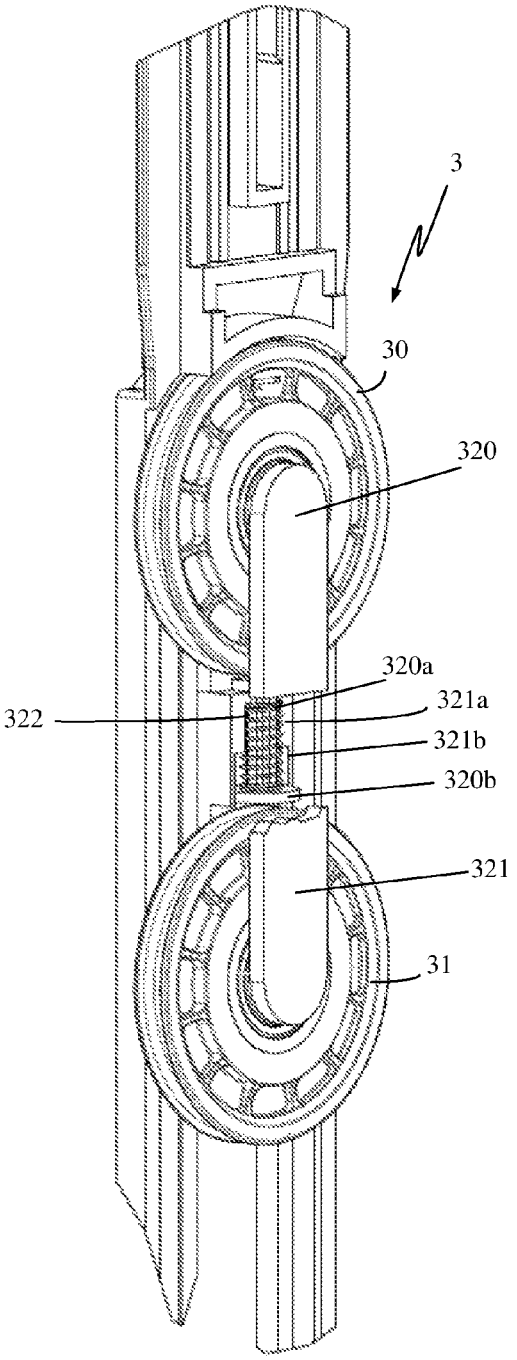
Figure 7B:
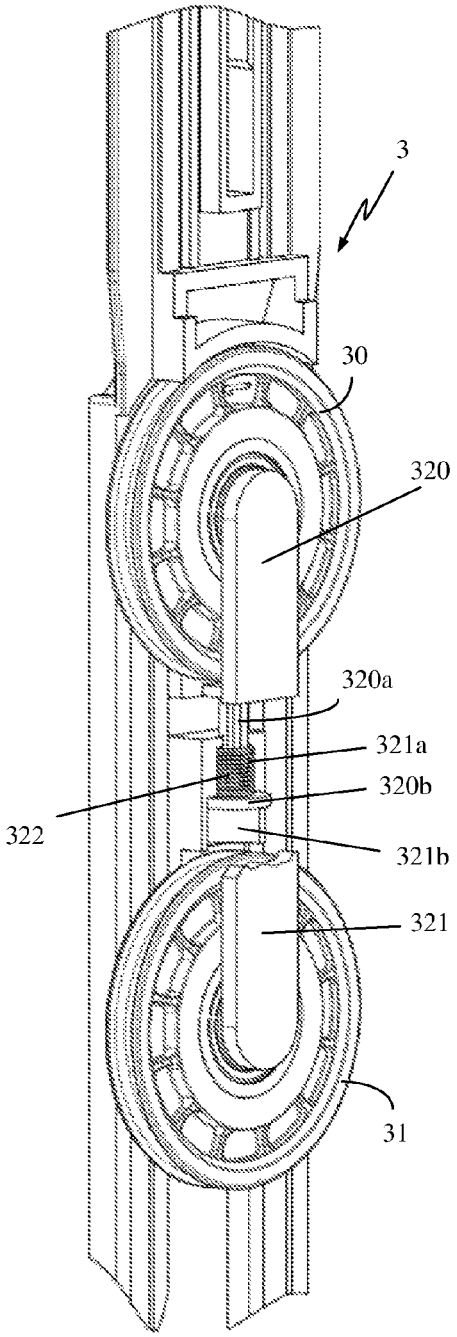
Figure 8A:
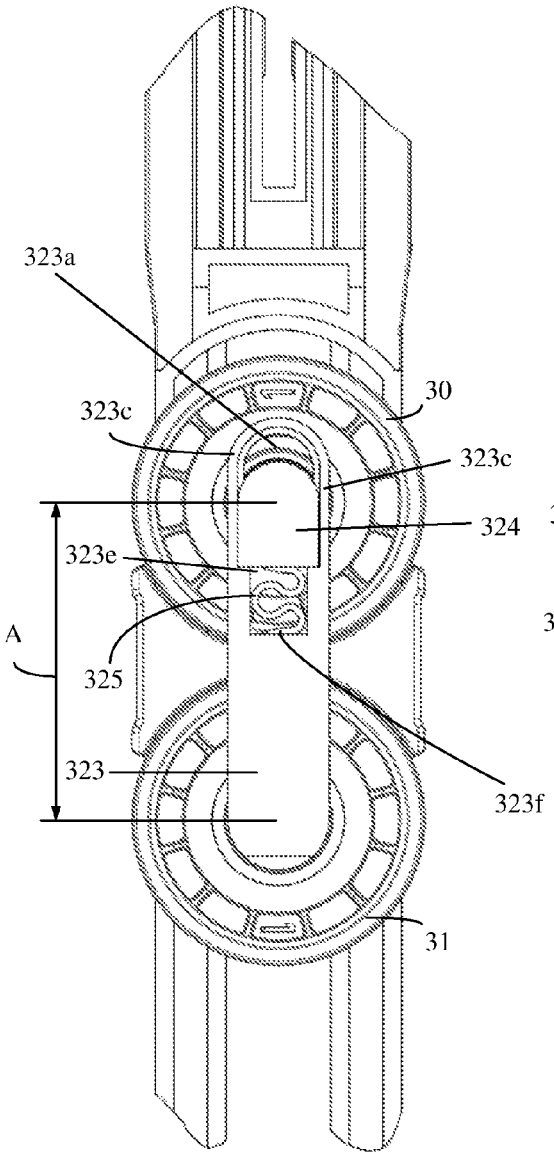
Figure 8B:
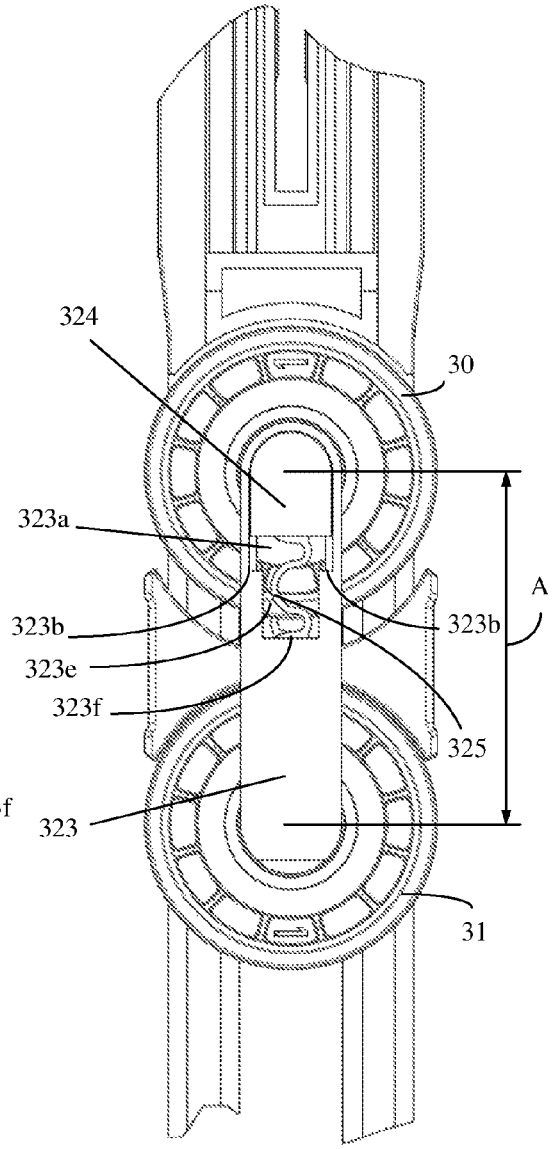
Figure 9A:
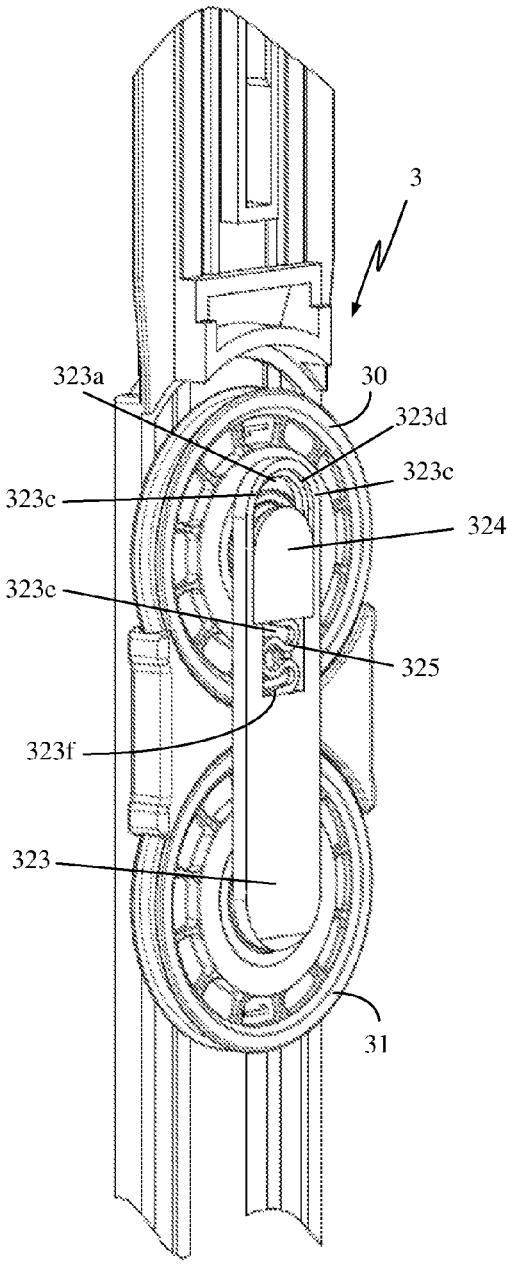
Figure 9B:
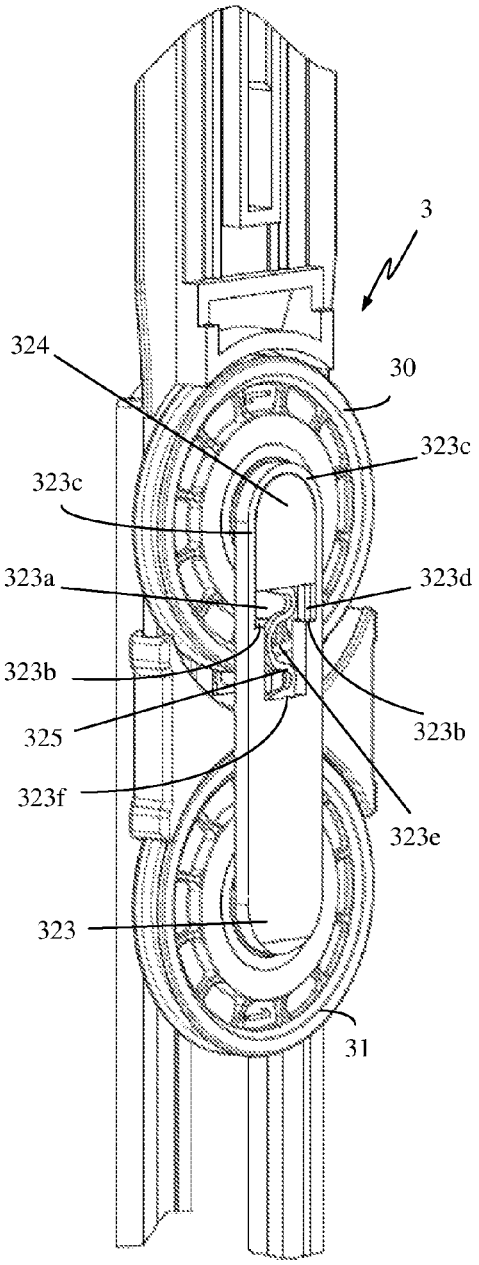
Figure 10A:
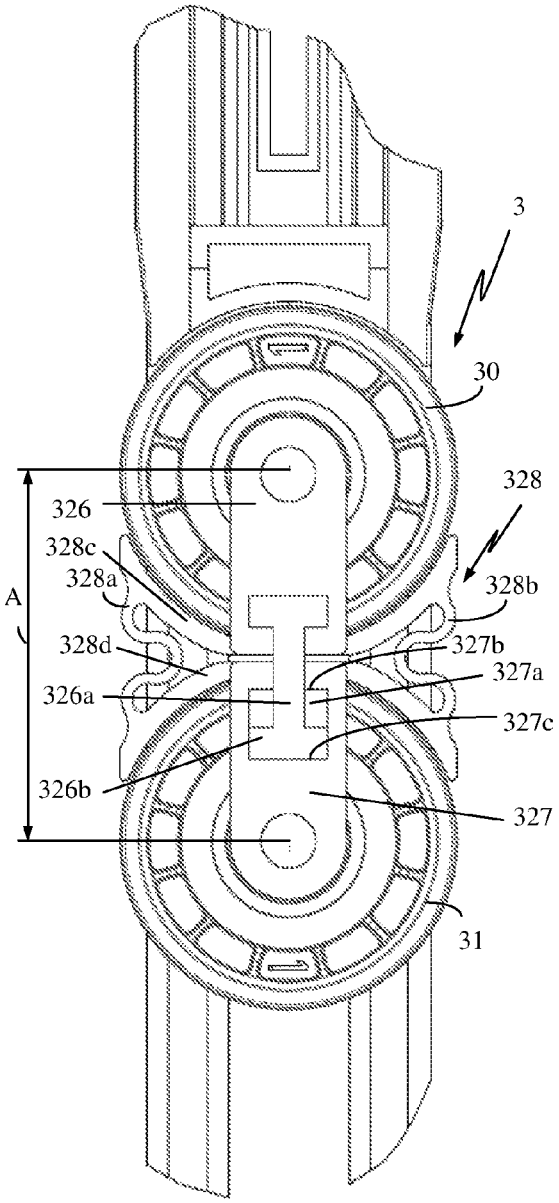
Figure 10B:
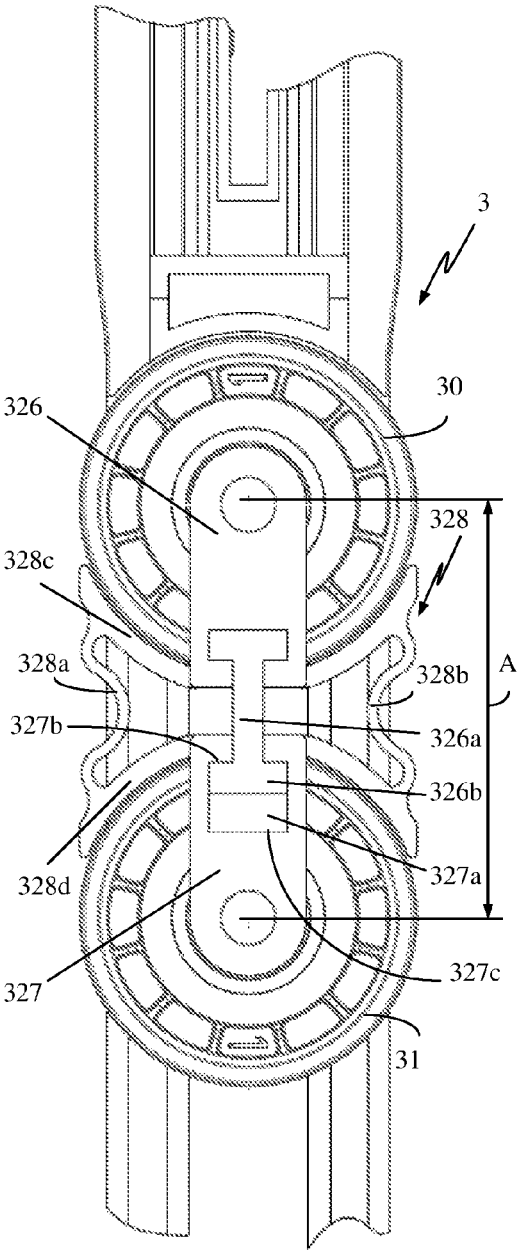
Figure 11A:
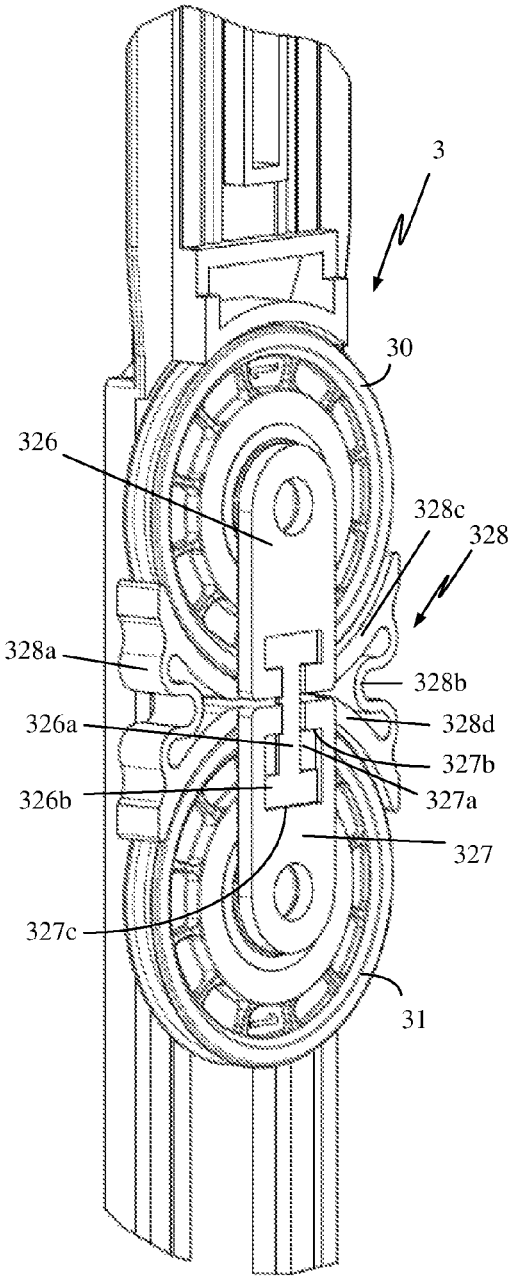
Figure 11B:
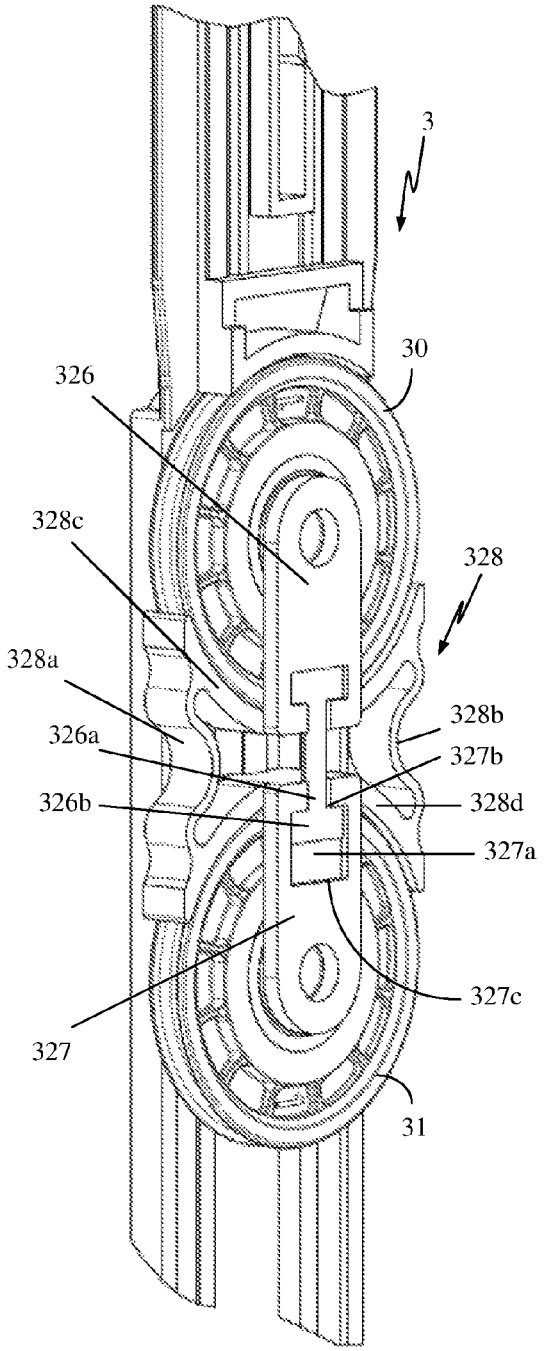
Figure 12A:
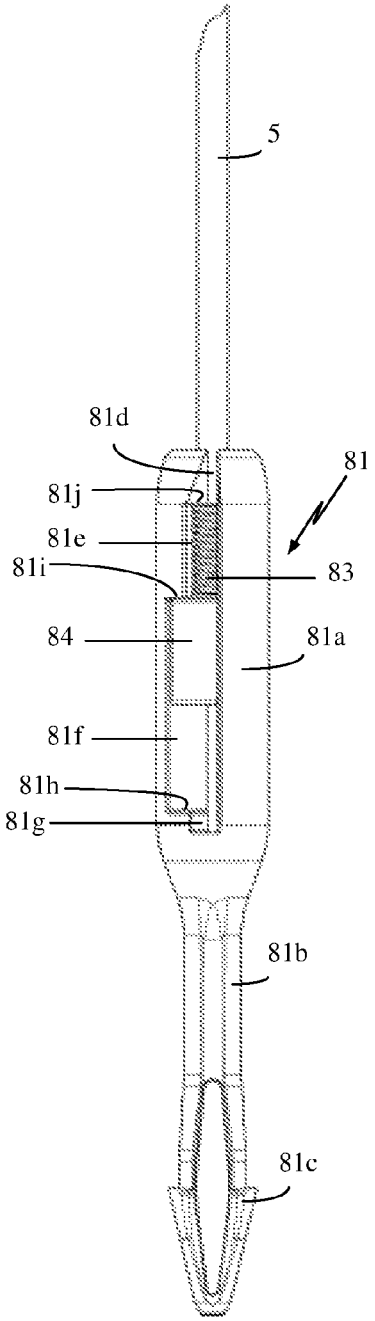
Figure 12B:
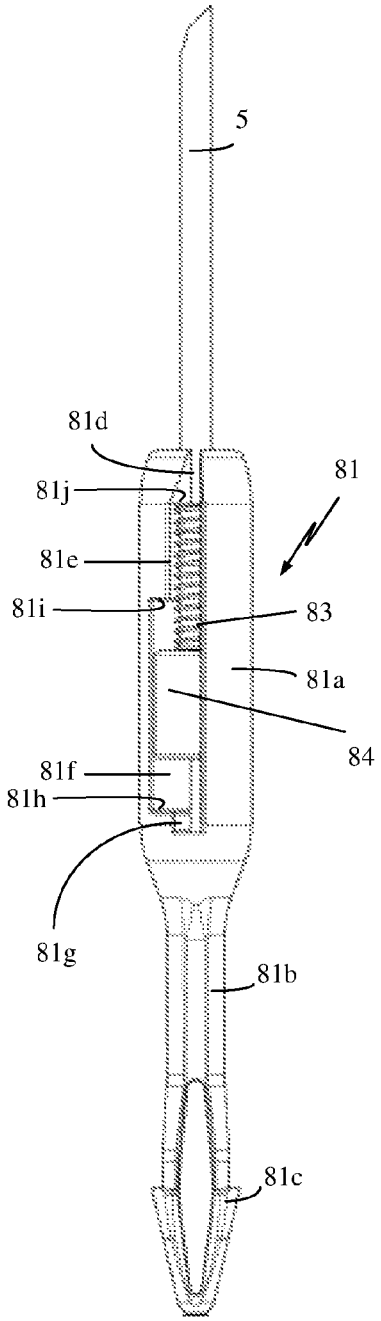
Figure 13A:
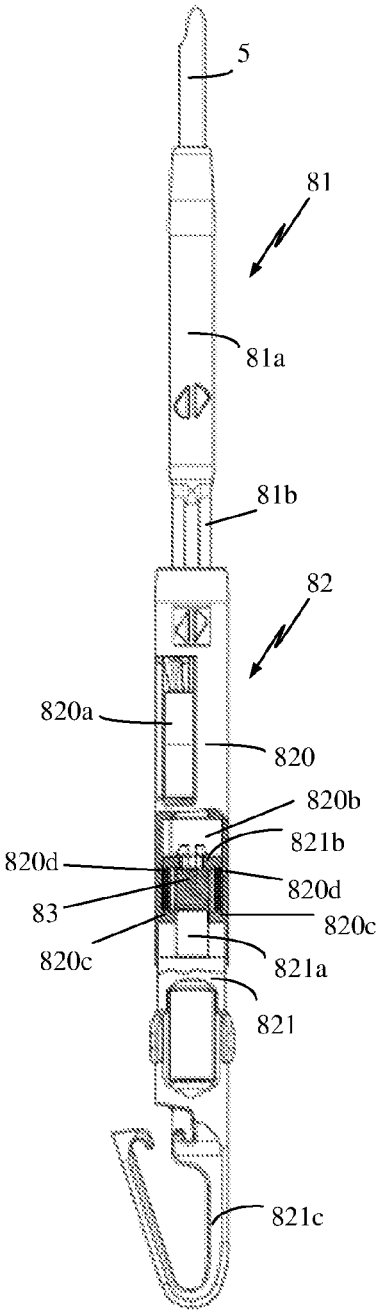
Figure 13B:
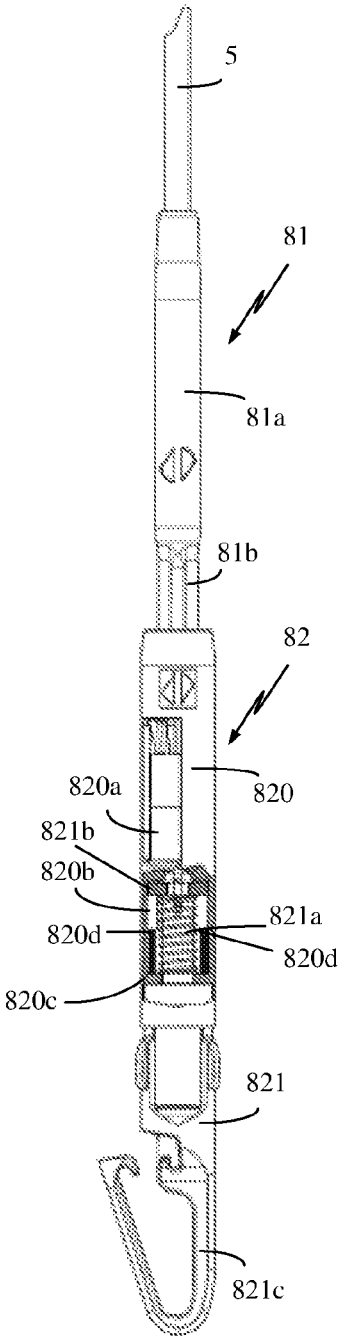
Figure 14A:
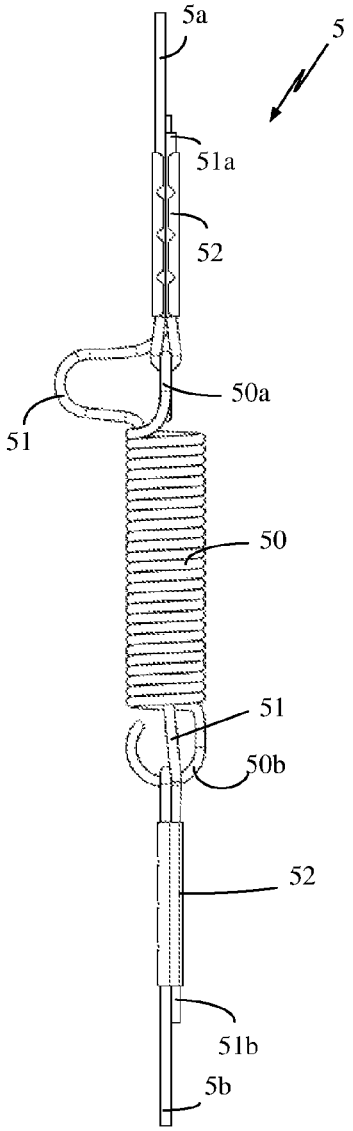
Figure 14B:
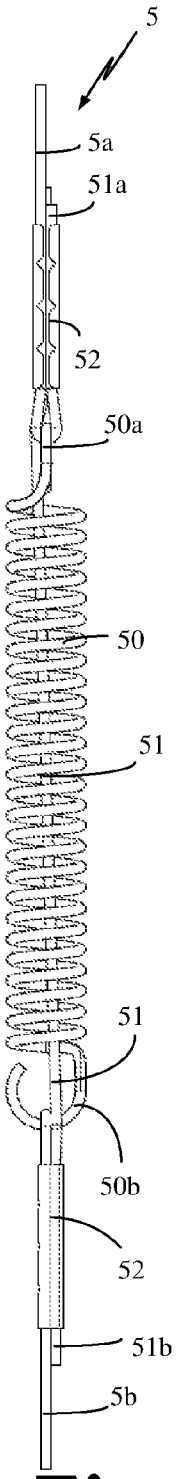

FIGS. 6A and 6B, FIGS. 8A and 8B, and FIGS. 10A and 10B each show a side view of two different states of a first, second and third embodiment of a pulley element designed as a tensioning element for a motion system according to this invention;

FIGS. 7A and 7B show a perspective view of the two states of the pulley element in FIGS. 6A and 6B;

FIGS. 9A and 9B show a perspective view of the two states of the pulley element in FIGS. 8A and 8B;

FIGS. 11A and 11B show a perspective view of the two states of the pulley element in FIGS. 10A and 10B;

FIGS. 12A and 12B show a side view of two different states of a male connector part of a harness connector designed as a tensioning element for a motion system according to this invention;

FIGS. 13A and 13B show a side view of two different states of a harness connector designed as a tensioning element for a motion system according to this invention;

FIGS. 14A and 14B show a side view of two different situations of a pulley cord designed as a tensioning element for a motion system according to this invention.

A jacquard device according to this invention (see FIG. 1) comprises a driving mechanism with sets of two knives (I), (II) which can be reciprocally driven in anti-phase in an up-and-down motion between a lowermost and an uppermost position as known from the prior art.

The jacquard device also comprises a series of motion systems to position the warp threads on a weaving machine during shed formation in the consecutive weaving cycles. Each motion system comprises two interacting hooks that can be carried by a respective knife (I), (II) of a set of knives. Each hook (1), (2) can also be selected by means of selection units not shown in the figures in order to be held at a fixed height and not carried by the corresponding knife (I), (II). The motion of the hooks (1), (2) are transmitted by the various elements of the motion system to one or more warp threads as explained further below. By appropriate selection or non-selection of each of the two hooks (1), (2) of a motion system, the warp threads can each be positioned in a number of possible positions during the consecutive weaving cycles. The selection units are controlled in order to position the warp threads in such a way that a fabric with the desired characteristics is woven.

In order to transmit the motion of the hooks (1), (2) to the warp threads, each motion system has not only these hooks (1), (2) but also a pulley element (3) located below the hooks which has an uppermost pulley (30) and a lowermost pulley (31) that are joined together by means of a connecting piece (32). The two interacting hooks (1), (2) are connected to a respective end of an uppermost pulley cord (4) that extends downwards from the hooks (1), (2) and runs over the uppermost pulley (30). A lowermost pulley cord (5) extends downwards from the lowermost pulley (31) and runs over this pulley (31), one end of said cord being connected by means of a connecting element, called an anchor (6), to a fixed part (7) of the jacquard device, and the other end of said cord being connected via a harness connector (8) to a harness cord (9) which in turn is connected to a heddle (10) comprising a heddle eyelet (10*a*). Due to the fact that the warp threads extend through this heddle eyelet (10*a*), they can be positioned by the motion system. The heddle (10) is connected via a return spring (11) to a lower fixed part (12) that may or may not be connected directly to the "solid world". The return spring (11) that here takes the form of a spiral spring thus exerts a permanent downward-directed force on the heddle (10) in order to be able to displace the heddle (10) quickly and reliably to a lower position.

According to this invention, one or more of said elements (1-9) of each motion system can be designed as a tensioning element in order to keep the elements of the motion system under tension and/or to keep the vertical parts of the pulley cords (4), (5) and the harness cord (9) taut. A number of possibilities are presented below in a non-limitative way.

In a first possibility (see FIGS. 2, 3, 4 and 5) the jacquard device comprises motion systems in which the anchor (6) forming the connection between the lowermost pulley cord (5) and a fixed part (7) of the jacquard device is designed as a tensioning element. A similar anchor (6) is connected to the uppermost end of each lowermost pulley cord (5) of the motion system.

Figure 2:
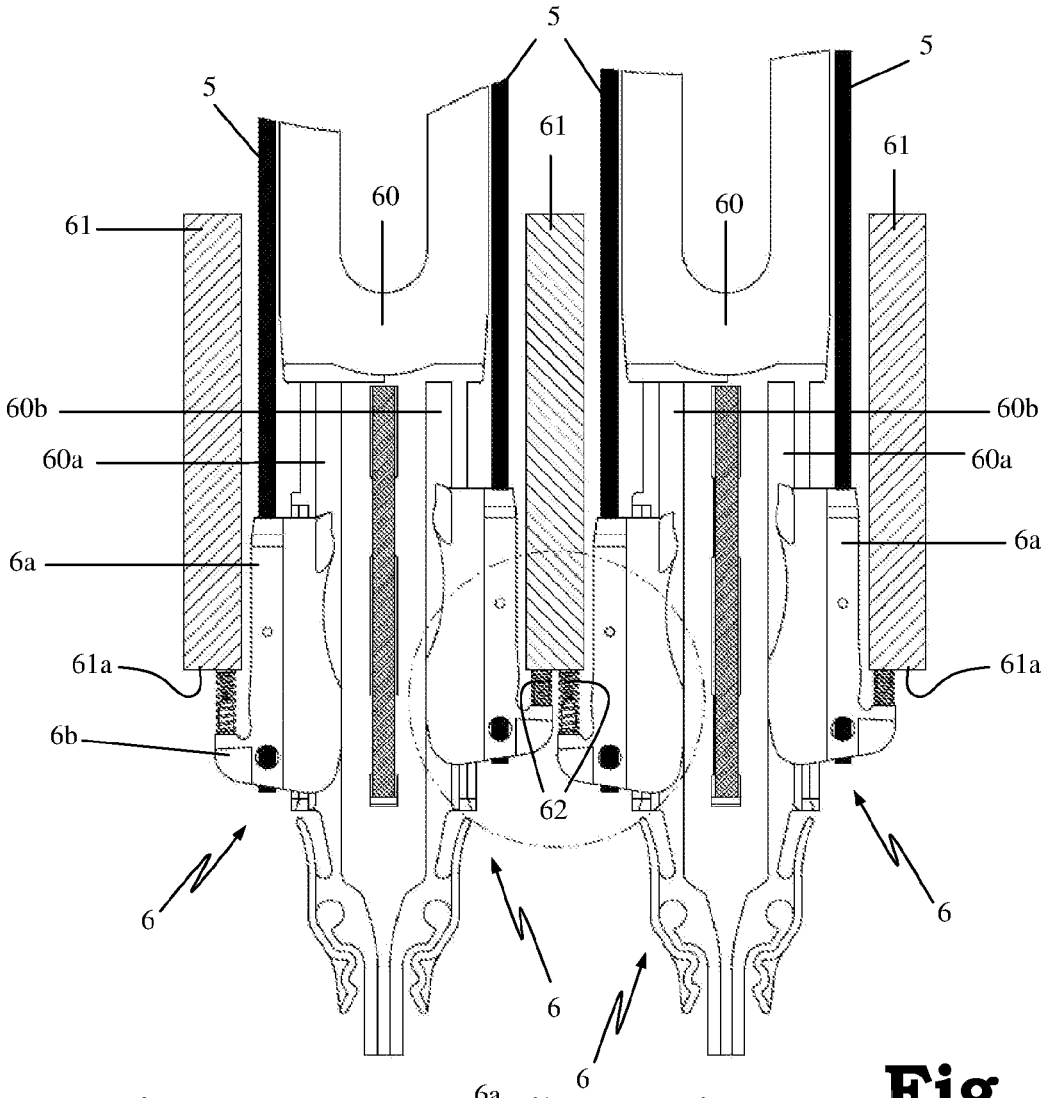
FIGS. 2 and 4 show a side view of a partial cross section of four connecting elements located alongside one another that form the connection between the lowest pulley cords and a fixed part of the jacquard device, respectively, and are designed as tensioning elements in a motion system according to this invention, whereby these figures show two different embodiments.
Figure 3:
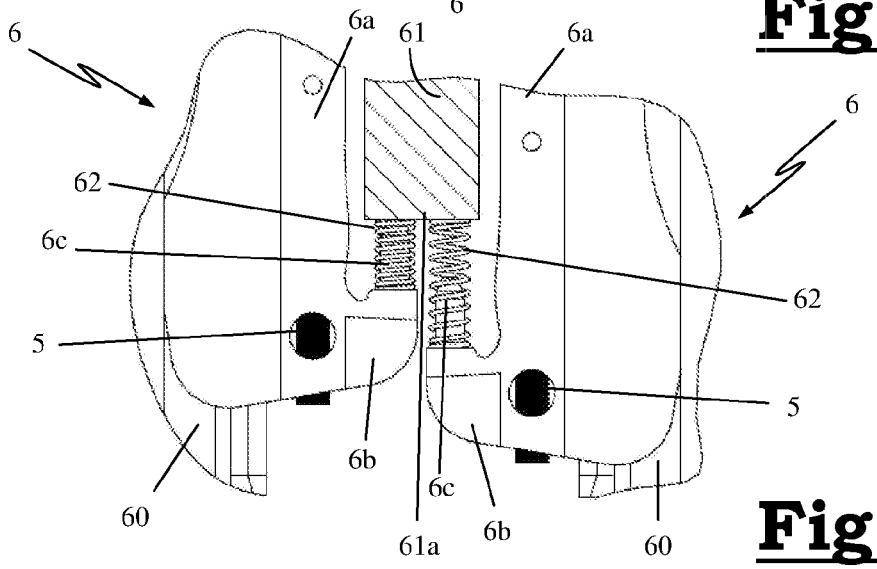
FIG. 3 shows the circled zone in FIG. 2 in enlarged form.
Figure 4:
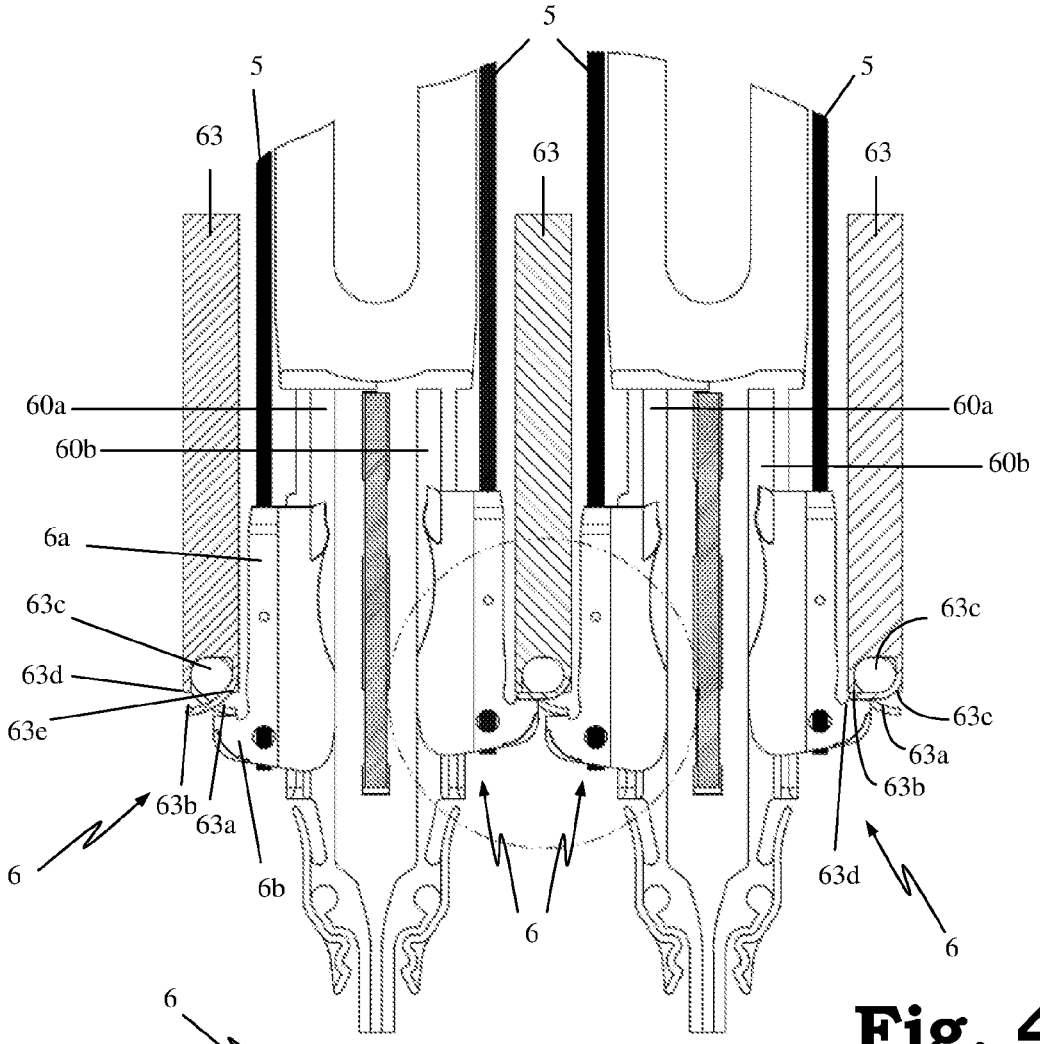

FIGS. 2 and 4 show the uppermost ends of the lowermost pulley cords (5) and the anchors (6) connected to them of four motion systems of the jacquard machine that have an alternate left-hand and right-hand anchor point. Between every two motion systems that have a left-hand and a right-hand anchor point, respectively (hereinafter referred to as left and right motion system) is a partition (60) with vertical guides (60*a*), (60*b*) that forms part of a modular structure. These guides (60*a*), (60*b*) form a vertical guideway (60*a*), (60*b*) for each anchor (6) of these left and right motion systems.

Each anchor (6) is designed as an essentially L-shaped body with a vertical leg (6*a*) in which a channel is provided and in which the uppermost end of a lowermost pulley cord (5) is guided and secured, and which is vertically adjustably connected to a guideway (60*a*), (60*b*) of a partition (60) and which comprises a leg (6*b*) protruding to the side at its lower end. On the upper side of the leg (6*b*) protruding to the side is a finger (6*c*) protruding upwards (see in particular FIG. 3). Around each finger (6*c*) is a spiral spring (62) that in the untensioned state extends beyond the upper side of the finger (6*c*).

Mounted between two adjacent partitions (60) is a stop profile (61) that extends between the vertical surfaces in which the pulley cords (5) coupled to these two partitions (60) are located. Each stop profile (61) is located above the two anchors (6) of these pulley cords (5) in such a position that the fingers (6*c*) and the spiral springs (62) of these anchors (6) come into contact with the underside (61*a*) of the stop profile (61) when the anchors (6) are moved upwards on their guideway (60*a*), (60*b*). Each stop profile (61) is mounted by means of mounting elements (not shown in the figures) that allow the mounting height to be changed so that the height of the underside (61*a*) can be adapted to the motion systems with which it operates.

Figure 1:
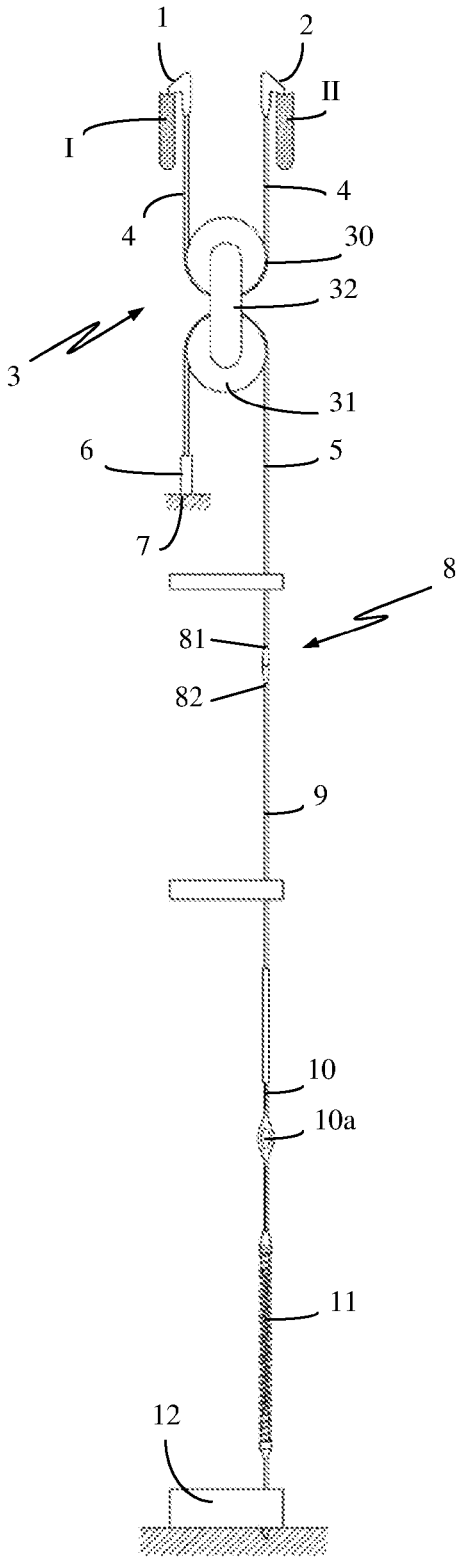

The elastic properties of the spiral spring (62) and the return spring (11) are such that the downward force that the return spring (11) of the motion system exerts on the heddle (10) under normal operating conditions results in an upward force on the anchor (6) that is sufficient to pull the anchor (6) up via the harness cord (9) and the lowermost pulley cord (5)—see FIG. 1—until the finger (6*c*) contacts the underside (61*a*) of the stop profile (61) and the spiral spring (62) is consequently compressed against this underside (61*a*). This is the situation of the anchor (6) of the second and fourth motion system in FIG. 2 (the left motion system is regarded as the first) and the situation of the left anchor in FIG. 3.

Due to the function of the return spring (11), the spiral spring (62) is compressed against the underside (61*a*) and potential energy is built up in the form of elastic energy. This energy ensures a permanent downward-directed tensioning force on the anchor (6), and hence also on the end of the lowermost pulley cord (5) connected to said anchor. Under certain (undesirable) operating conditions, the return spring (11) (temporarily) exerts a reduced tractive force. This occurs if the return spring itself fails and no longer develops sufficient force, but also if blocking occurs in the motion system between the return spring (11) and the spiral spring (62), or if the inertia of the elements of the motion system results in the tension of the return spring not being (completely) transmitted (for example, in the event of collisions or vibrations) to the motion system. The return spring (11) is then no longer able to keep the motion system under tension. As soon as a smaller downward force than the maximum return spring force is exerted on the anchor (6), the spiral spring (62) can relax more and push the anchor (6) to a lower position so that the finger (6*c*) is no longer in contact with the bottom surface (61*a*) of the stop profile (61). As a result of this downward displacement of the anchor (6) and the attached end of the lowermost pulley cord (5), all vertical parts of the cords (4), (5), (9) of the motion system maintain their taut state. In this way the spiral spring (62) will keep the cords (4), (5), (9) taut even if the force exerted by the spiral spring (11) fails almost completely. This tensioning effect is achieved because the return spring (11) is at the outermost point of the motion system while the spiral spring (62) is located between the return spring (11) and the knives (I), (II) in the motion system.

Figure 5:
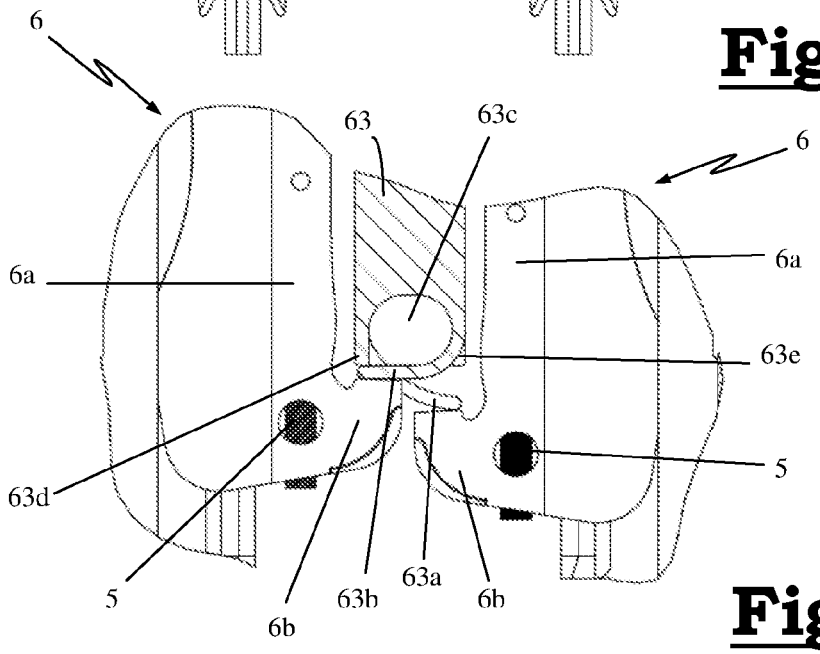
FIG. 5 shows the circled zone in FIG. 4 in enlarged form.

The motion systems shown in FIG. 4 differ from the motion systems in FIG. 2 in that the leg (6*b*) protruding to the side of each anchor (6) has a flat upper side so that there is no finger with a spiral spring here, while the stop profile has a different form, namely as a stop profile (63) of which the underside comprises two elastically deformable wings (63*a*), (63*b*) separated by a central recess (63*c*). The central recess (63*c*) is open on the underside. In the relaxed state the wings extend obliquely downwards in the direction of the opposite wing (just as the wing (63*a*) in FIG. 5 is in contact with the right anchor) and are elastically deformable in the upward direction. Alongside each wing (63*a*), (63*b*) is a bumper (63*d*), (63*e*) so that at maximum elastic deformation, each wing (63*a*), (63*b*) comes into contact with the bumper (63*e*), (63*d*) located in the opposite side of the recess (63*c*) as is the case for the wing (63*b*) that in FIG. 5 is pressed by the left anchor (6) against the bumper (63*d*).

Mounted between two adjacent partitions (60) in each case is a similar stop profile (63) that extends between the vertical surfaces in which the pulley cords (5) coupled to these two partitions (60) are located. Each stop profile (63) is located above the two anchors (6) of these pulley cords (5) in such a position that the flat upper side of the leg (6*b*) protruding to the side of each of these anchors (6) comes into contact with a respective wing (63*a*), (63*b*) and deforms this wing when the anchor (6) is moved upwards on its guideway (60*a*), (60*b*). Each stop profile (63) is mounted by means of mounting elements (not shown in the figures) that allow the mounting height to be changed so that the height of the wings (63*a*), (63*b*) can be adapted to the motion systems with which they operate.

The elastic properties of the deformable wings (63*a*), (63*b*) and the return spring (11) are such that the force that the return spring (11) of the motion system exerts under normal working conditions is sufficient to pull up the anchor (6) until the wings (63*a*), (63*b*) reach maximum deformation up against a respective bumper (63*e*), (63*d*). This is the situation of the anchor (6) of the second and fourth motion system in FIG. 4 (the left motion system is regarded as the first) and the situation of the left anchor in FIG. 5.

The function of the wings (63*a*), (63*b*) corresponds to the function of the spiral spring (62) in the embodiment shown in FIG. 2. Due to the function of the return spring (11), the anchor (6) of the corresponding motion system is displaced upwards against a wing (63*a*), (63*b*) of the stop profile (63) and this wing is deformed, thereby building up potential energy in the form of elastic energy. This energy ensures a permanent downward-directed tensioning force on the anchor (6), and hence also on the end of the lowermost pulley cord (5) fastened thereto. As described above, certain (undesirable) operating conditions can occur whereby the return spring (temporarily) exerts a reduced tractive force that is no longer sufficient to keep the motion system under tension. As explained above, this can occur due to the fact that the return spring itself fails, but also as a result of blocking in the motion system, or if the inertia of the elements in the motion system results in the tension of the return spring not being (completely) transmitted (for example, in the event of collisions or vibrations) to the motion system. This reduced tractive force of the return spring (11) causes the anchor (6) to be subjected to a smaller upward force. As a result, the deformed wing (63*a*), (63*b*) should be able to spring back and push the anchor (6) into a lower position so that the wing (63*a*), (63*b*) is no longer in contact with its bumper (63*e*), (63*d*). As a result of this downward displacement of the anchor (6) and the connected end of the lowermost pulley cord (5), this pulley cord (5) maintains its taut state. The vertical parts of the other cords (4), (9) consequently also remain under tension and in the taut state. In this way the wing (63*a*), (63*b*) can keep all the elements of the motion system taut even if the force exerted by the spiral spring (11) fails almost completely. This tensioning effect is achieved because the return spring (11) is at the outermost point of the motion system while the wings (63*a*), (63*b*) are located between the return spring (11) and the knives (I), (II) in the motion system.

In a second possibility the jacquard device comprises motion systems with a pulley element (3) that is designed as a tensioning element. FIGS. 6A, 6B, 7A and 7B show a first possible embodiment of such a pulley element. FIGS. 8A, 8B, 9A and 9B show a second possible embodiment and FIGS. 10A, 10B, 11A and 11B show a third possible embodiment. In all the embodiments, the pulley element (3) comprises an uppermost (30) and a lowermost pulley (31) that are pivotably mounted above one another on a common intermediate section (32).

In the first embodiment, the intermediate section (32) is in two parts with an uppermost intermediate part (320) and a lowermost intermediate part (321). In FIGS. 6A, 6B, 7A and 7B, part of the front wall of the intermediate part has been removed in order to allow the internal parts to be seen.

The uppermost intermediate part (320) comprises a pin (320*a*) which at its end has a disc-shaped body (320*b*). Around the pin (320*a*) is a spiral spring (322). Inside the lowermost intermediate part (321) is a cylindrical chamber (321*a*, 321*b*) with an uppermost chamber section (321*a*) that broadens step-wise and transitions into a lowermost chamber section (321*b*) with a larger diameter, wherein the chamber (321*a*, 321*b*) is accessible via an axial passage extending from the uppermost end of the lowermost intermediate part (321) and terminating in the uppermost chamber section (321*a*).

The pin (320*a*) of the uppermost intermediate part (320) extends via the passage into the wider lowermost chamber section (321*b*) of the lowermost intermediate part (321), while the disc-shaped body (320*b*) is fitted radially into the wider chamber section (321*b*) and the spiral spring (322) is located around the pin (320*a*) and extends from the upper side of the disc-shaped body (320*b*) into the narrower uppermost chamber section (321*a*). As the disc-shaped body (320*b*) can be displaced vertically in the wider chamber section (321*b*), the lowermost pulley (31) can also be displaced vertically relative to the uppermost pulley (30).

Under normal operating conditions, the return spring (11) exerts a downward force via the harness cord (9) and the lowermost pulley cord (5) on the lowermost pulley (31) that is sufficient to displace the lowermost pulley (31) to the furthest possible position relative to the uppermost pulley (30). In this position (shown in FIGS. 6B and 7B) the body (320*b*) is against the upper wall of the wider chamber section (321*b*), while the spiral spring (322) is compressed in the narrower chamber section (321*a*). The vertical distance (A) between the rotation axes of the uppermost (30) and lowermost pulley (31) is therefore at a maximum here. The spiral spring (322) permanently exerts a tensioning force so that the two intermediate parts (320), (321) of the intermediate section (32) are pushed towards one another. The spiral spring (322) therefore acts here like a pressure spring.

Under certain operating conditions, the return spring (11) may (temporarily) exert a reduced downward force on the heddle (10), or a blocking in the motion system above the heddle (10) or the inertia of the elements in the motion system may result in the tension of the return spring (11) not being (completely) transmitted, so that it could no longer be guaranteed that the cords (4), (5), (9) of the motion system could be kept taut if there were no tensioning element. Due to the presence of the pulley element (3) in the form of a tensioning element, this can be prevented as follows. Due to the reduced tractive force of the return spring (11), the downward force on the lowermost pulley (31) also becomes smaller, and this lowermost pulley (31) is displaced upward relative to the uppermost pulley (30) under the force of the spiral spring (322). The body (320*b*) of the uppermost intermediate part (320) is thereby displaced downwards into the wider chamber section (321*b*) of the lowermost intermediate part (321), to a new position in which the uppermost (30) and lowermost pulley (31) are closer together.

This relative displacement of the uppermost (30) and lowermost pulley (31) reduces the vertical distance (A) between the uppermost (30) and lowermost pulley (31) from the maximum distance—the situation in FIGS. 6B and 7B—to a smaller distance, whereby all the cords (4), (5), (9) of the motion system are kept taut. The most extreme position in which the lowermost pulley (31) is displaced to the maximum distance upwards, and the body (320*b*) is displaced against the bottom of the wider chamber section (321*b*), and in which the distance (A) is therefore at a minimum, is shown in FIGS. 6A and 7A.

The principle of a two-piece intermediate section (32) is applied also in the second embodiment of the pulley element (3) designed as a tensioning element, whereby both intermediate parts (323), (324) can be displaced relative to one another between two positions with different distances (A) between the pulleys (30), (31), and whereby a spring element (325) ensures that the pulleys (30), (31) are forced into the relative position with the minimum distance (A).

Here the one intermediate part is an arm (323) that is connected at one end to the lowermost pulley (31), and at the other end has a recess (323*a*, 323*e*) consisting of two parts with different widths. The wider uppermost part (323*a*) transitions step-wise into the narrower lowermost part (323*e*) of the recess, so that two transverse edges (323*b*) are formed which border the lower end of the wider part (323*a*) of the recess. This wider part (323*a*) is bordered at the side by two parallel edges (323*c*) which transition into an arc-shaped upper edge. These parallel edges (323*c*) have projections (323*d*) facing towards one another that are only indicated in FIGS. 9A and 9B and whose function is explained in more detail below.

The other intermediate part is a sliding body (324) to which the uppermost pulley (30) is pivotably connected, and which is located in the wider uppermost part (323*a*) of the recess. The width of the sliding body (324) corresponds to the width of the wider part (323*a*) of the recess, while the sliding body (324) has a smaller height so that it is displaceable vertically in this part (323*a*) of the recess. The side edges of the sliding body (324) are shiftably restrained against the above-mentioned projections (323*d*).

The narrower part (323*e*) is bordered at the lower end by an end edge (323*f*). Between the underside of the sliding body (324) and this end edge (323*f*) is a spring element (325) that is designed as an elastically deformable element with a zigzag-shaped form that is made, for example, of plastic. The non-deformed condition of this spring element (325) can be seen in FIGS. 8A and 9A. In FIGS. 8B and 9B the spring element (325) has maximum elastic deformation.

Under normal operating conditions, the return spring (11) exerts a downward force via the harness cord (9) and the lowermost pulley cord (5) on the lowermost pulley (31) that is sufficient to displace the lowermost pulley (31) to the furthest possible position relative to the uppermost pulley (30). In this position (shown in FIGS. 8B and 9B) the sliding body (324) is against the arc-shaped wall which borders the recess (323*a*) at the upper end and is therefore displaced to the maximum distance upwards, while the spring element (325) has maximum deformation. The vertical distance (A) between the rotation axes of the uppermost (30) and lowermost pulley (31) is therefore at a maximum here. The potential energy built up in the spring element results in a permanent tensioning force so that the two intermediate parts (323), (324) of the connecting piece (32), and hence also the connected pulleys (30), (31), are forced towards one another. The spring element (325) acts as a tension spring here.

By analogy with the first embodiment, the presence of this pulley element (3) therefore prevents the vertical parts of the cords (4), (5), (9) not remaining taut in the event of a reduced tractive force of the return spring (11). This reduced tractive force here naturally also results in a reduced downward force on the lowermost pulley (31), so that the uppermost (30) and lowermost pulley (31) are displaced towards one another by the force of the spring element (325). The sliding body (324) is thereby displaced downwards into the wider part (323*a*) of the recess into a new position in which the uppermost (30) and lowermost pulley (31) are closer together.

This relative displacement of the uppermost (30) and lowermost pulley (31) reduces the vertical distance (A) between the uppermost (30) and lowermost pulley (31) from the maximum distance—the situation in FIGS. 8B and 9B—to a smaller distance (A), whereby all the cords (4), (5), (9) of the motion system are kept taut. The most extreme position in which the two pulleys (30), (31) are displaced by the maximum distance towards one another, and in which the sliding body (324) is displaced up against the transverse edges (323*b*) bordering the underside of the wider part (323*a*) of the recess, and in which said distance (A) is therefore at a minimum, is presented in FIGS. 8A and 9A.

The principle described above is also applied in the third embodiment. Here the intermediate section (32) consists of two elongated connecting pieces (326), (327) that are pivotably connected to a respective pulley (30), (31). The two connecting pieces extend in a straight line in the vertical direction of the motion system and are joined to one another. The uppermost connecting piece (326) has a T-shaped coupling element (326*a*, 326*b*) that extends downwards beyond the free end of the connecting piece. The coupling element has a neck (326*a*) and an attached head piece (326*b*). The lowermost connecting piece (327) has an internal space (327*a*) in the vicinity of the free end that is limited at its upper end by an upper wall (327*b*) and at its lower end by a lower wall (327*c*). The internal space (327*a*) is accessible via a passage in the upper wall. The neck (326*a*) extends via this passage into the internal space (327*a*) while the head piece (326*b*) is located into the internal space (327*a*). This connection also allows a relative displacement of the pulleys (30), (31) in the vertical direction.

Between the two pulleys (30), (31) is a one-piece spring body (328) with two elastically deformable flanks (328*a*), (328*b*) that form the connection between an uppermost bridge section (328*c*) and a lowermost bridge section (328*d*). The uppermost bridge section (328*c*) is connected to the uppermost pulley (30) while the lowermost bridge section (328*d*) is connected to the lowermost pulley (31). The non-deformed condition of this spring body (328) can be seen in FIGS. 10A and 11A. In FIGS. 10B and 11B the spring body (328) has maximum elastic deformation.

Under normal operating conditions, the return spring (11) exerts a downward force via the harness cord (9) and the lowermost pulley cord (5) on the lowermost pulley (31) that is sufficient to displace the lowermost pulley (31) to the furthest possible position relative to the uppermost pulley (30). In this position (shown in FIGS. 10B and 11B) the head piece (326*b*) in the internal space (327*a*) is in contact with the upper wall (327*b*), and therefore displaced to the maximum distance upwards, while the flanks (328*a*), (328*b*) of the spring body (328) have maximum deformation. The vertical distance (A) between the rotation axes of the uppermost (30) and lowermost pulley (31) is therefore at a maximum here. The potential energy built up in the spring element (328) results in a permanent tensioning force so that the two intermediate parts (326), (327) of the intermediate section (32), and hence also the connected pulleys (30), (31), are forced towards one another. The spring body (328) thus also acts as a tension spring here.

By analogy with the function of the first and second embodiment, a smaller downward force on the lowermost pulley (31) will result in the spring body (328) springing back so that the uppermost (30) and lowermost pulley (31) are displaced towards one another. The head piece (326*b*) is thereby displaced downwards into the internal space (327*a*) into a new position in which the uppermost (30) and lowermost pulley (31) are closer together. This relative displacement of the uppermost (30) and lowermost pulley (31) reduces the vertical distance (A) between the uppermost (30) and lowermost pulley (31) from the maximum distance—the situation in FIGS. 10B and 11B—to a smaller distance, whereby all the cords (4), (5), (9) of the motion system are kept taut. The most extreme position in which the two pulleys (30), (31) are displaced to the maximum distance towards one another, and in which the head piece (326*b*) is displaced against the lower wall (327*c*) of the internal space (327*a*), and in which the distance (A) is therefore at a minimum, is shown in FIGS. 10A and 11A.

In a third possibility the jacquard device comprises motion systems with a harness connector (8) that is designed as a tensioning element. The harness connector (8) consists of a male connector part (81) connected to a pulley cord (5) and a female connector part (82) connected to one or more harness cords (9). These two connector parts (81), (82) can be coupled together to form the connection between the pulley cord (5) and the harness cords (9). The male connector part (81) comprises a predominantly cylindrical base (81*a*) that transitions into an elongated stem (81*b*) on which an elastically deformable head (81*c*) is formed at its end. The female connector part (82) comprises a locating space (820*a*) for the head (81*c*) of the male connector part (81) that is accessible via a channel that extends from one end of the connector part (82) and terminates in the locating space (820*a*). At the other end the female connector part (82) has a hook (821*c*) for the connection to one or several harness cords (9) (not shown in FIGS. 12A to 13B).

The stem (81*b*) of the male part (81) can be moved via the channel into the locating space (820*a*) until the head (81*c*) is in the intended coupling position in the locating space (820*a*) so that the male (81) and the female connector part (82) are coupled. FIGS. 12A and 12B show the male connector part (81) of such a connector (8) that in a first possible embodiment is designed as a tensioning element.

In the male part (81) there is a cylindrical channel (81*d*, 81*e*, 81*f*, 81*g*) extending axially from one end that has four parts with different diameters that transition step-wise into one another: a first part (81*d*) that extends from the end, a second part (81*e*) whose diameter is larger than that of the first part (81*d*), a third part (81*f*) whose diameter is larger than that of the second part (81*e*) and which forms a motion space for the cylindrical body (84) that is connected to the pulley cord (5), as explained further below. Finally there is a fourth part (81*g*) whose diameter is smaller again than that of the third part (81*f*). The step-wise changes in diameter form inclined walls in the channel.

The pulley cord (5) extends via the passage forming the first (81*d*) and the second part (81*e*) of the channel and into the widest third part (81*f*) where the pulley cord (5) is connected to a cylindrical body (84) located radially in this third part (81*f*) of the channel. The height of the cylindrical body (84) is smaller than the height of the third part (81*f*) of the channel, while the diameter of the cylindrical body (84) is only slightly smaller than that of the channel, and in any case larger than the diameters of the second (81*e*) and fourth part (81*f*) of the channel. The cylindrical body (84) can therefore be displaced up and down in the third part (81*f*) of the channel, between a lowermost position in contact with the inclined walls (81*h*) that border the lower end of the third part (81*f*) and an uppermost position in contact with the inclined walls (81*i*) that border the upper end of the third part (81*f*).

Around the pulley cord (5) is a spiral spring (83) that extends axially from the upper side of the cylindrical body (84) into the second part (81*e*) of the channel where the uppermost end of the spiral spring (83) is in contact with the inclined wall (81*j*) that borders the upper end of the second part (81*e*) of the channel.

As the cylindrical body (84) can be displaced vertically in the third part (81*f*) of the channel, the anchoring point of the pulley cord (5) can be displaced vertically relative to the male connector part (81).

Under normal operating conditions, the return spring (11) exerts a downward force via the harness cord (9) and the female connector part (82) on the male connector part (81) that is sufficient to displace the cylindrical body (84) in the third part (81*f*) of the channel against the spring force of the spiral spring (83), to its uppermost position in contact with the inclined walls (81*i*) that border the upper end of the third part of the channel (81*f*). In this state (shown in FIG. 12A), the spiral spring (83) has maximum compression in the second part of the channel (81*e*) between the inclined wall (81*j*) bordering the upper end of the second part of the channel and the upper side of the cylindrical body (84).

The spiral spring (83) permanently exerts a tensioning force so that a downward-directed force is exerted on the cylindrical body (84). The spiral spring (83) therefore acts here like a pressure spring.

With a reduced tractive force of the return spring (11), the downward force on the male connector part (81) also becomes smaller, and this cylindrical body (84) is displaced to a lower position in the third part of the channel (81*f*) under the force of the spiral spring (83). This type of condition is shown in FIG. 12B. Since as a result the anchoring point of the pulley cord (5) comes closer to the anchoring point of the harness cord (9), all the cords (4), (5), (9) of the motion system are kept taut.

FIGS. 13A and 13B show a harness connector with a male connector part (81) and a female connector part (82) in the coupled state. In this embodiment the female connector part (82) is designed as a tensioning element. The female connector part (82) is made of two parts, with a basic part (820) in which there is a locating space (820*a*) for the head of the male connector part (81), and an end part (821) on which there is a hook (821*c*) for the connection of one or more harness cords (not shown in FIGS. 13A and 13B).

The end part (821) comprises a pin (821*a*) that has a disc-shaped body (821*b*) with a larger diameter at the end, and a spiral spring (83) around the pin (821*a*). In the basic part (820) under the locating space (820*a*) is a motion chamber (820*b*) that is accessible via a channel from the lowermost end of the basic part (820). The pin (821*a*) of the end part (821) extends via this channel into the motion chamber (820*b*). The disc-shaped body (821*b*) is located in the motion chamber (820*b*) and is displaceable axially in this space. The spiral spring (83) is supported at one end on an inclined wall (820*c*) and at the other end is in contact with the underside of the disc-shaped body (821*b*) and exerts an upward-directed force on the disc-shaped body (821*b*). The spiral spring (83) is a pressure spring.

As the disc-shaped body (821*b*) can be displaced vertically in the motion chamber (820*b*), the anchoring point of the harness cord (9) can be displaced vertically relative to the basis part (820) of the female connector part (82), and hence also relative to the anchoring point of the pulley cord (5).

Under normal operating conditions, the return spring (11) exerts a downward force via the harness cord (9) on the end part (821) that is sufficient to displace the disc-shaped body (821*b*) in the motion chamber (820*b*) into its lowermost position in the motion chamber (820*b*) against the spring force of the spiral spring (83). In this state (shown in FIG. 13A) the disc-shaped body (821*b*) is in contact with an inclined wall (820*d*) bordering the lower end of the motion chamber, and the spiral spring (821*c*) has maximum compression between the inclined wall (820*c*) on which the spiral spring (63) is supported and the underside of the disc-shaped body (821*b*).

The spiral spring (83) permanently exerts a tensioning force so that an upward-directed force is exerted on the cylindrical body (821*b*). In the event of a reduced tractive force of the return spring (11), the downward force on the end part (821) also becomes smaller, and the disc-shaped body (821*b*) is displaced to a higher position in the motion chamber (820*b*) under the force of the spiral spring (83). The most extreme position in which the disc-shaped body (821*b*) has been displaced against the upper wall of the motion chamber is shown in FIG. 13B. Since as a result the anchoring point of the harness cord (9) comes closer to the anchoring point of the pulley cord (5), all the cords (4), (5), (9) of the motion system are kept taut.

In a fourth possibility the jacquard device comprises motion systems with a pulley cord (5) that is designed as a tensioning element. The pulley cord (5) consists of two separate cord sections (5*a*), (5*b*) that are connected to a respective end (50*a*), (50*b*) of a spiral spring (50) and to a respective end part (51*a*), (51*b*) of an intermediate cord (51) that extends through the axial space inside the spiral spring (50). In order to form the connections to the spiral spring (50), a loop is formed at the end of each cord section (5*a*), (5*b*) by bending over the cord end and fastening it to the parallel run of the same cord using a clamping element (52). The hook-shaped ends (50*a*), (50*b*) of the spiral spring (50) are hooked into the loops thus formed. The end part (51*a*), (51*b*) of the intermediate cord (51) are fastened using the same clamping elements (52) to the respective cord sections (5*a*), (5*b*) of the pulley cord (5).

The length of the intermediate cord (51) between the anchoring points is such that the intermediate cord (51) is not taut when the spiral spring (50) is in its relaxed state (see FIG. 14A). When the cord sections (5*a*), (5*b*) are displaced away from one another against the spring force of the spiral spring (50), the spiral spring (50) is deformed so that it takes on a greater length. The maximum relative displacement of the cord sections (5*a*), (5*b*) is obtained when the intermediate cord (51) is stretched as shown in FIG. 14B.

Under normal operating conditions, the return spring (11) exerts a downward force via the harness cord (9) on the lowermost cord section (5*b*) of the pulley cord (5) that is sufficient to displace the cord section (5*b*) downwards relative to the uppermost cord section (5*a*) against the spring force of the spiral spring (50). In this state (FIG. 14B) the spiral spring (50) has the maximum elongation and the intermediate cord (51) is taut. The spiral spring (51) permanently exerts a tensioning force so that an upward-directed force is exerted on the lowermost cord section (5*b*). With a reduced tractive force of the return spring (11), the downward force on the lowermost cord section (5*b*) also becomes smaller, and the lowermost cord section (5*b*) is displaced to a higher position closer to the uppermost cord section (5*a*) under the force of the spiral spring (50). The intermediate cord (51) is then, of course, no longer taut. The most extreme position in which the spiral spring (50) in the relaxed state has taken on its minimum length, and the distance between the uppermost (5*a*) and the lowermost cord section (5*b*) is thus minimal, is shown in FIG. 14A. Since the effective length of the pulley cord (5) is reduced as a result, all the cords (4), (5), (9) of the motion system are kept taut.

The invention claimed is:

1. Shed forming device for a weaving machine comprising a number of motion systems consisting of a plurality of elements, each comprising, at least one carrier movable up and down by a driving element to position one or more warp threads in a shed, and transmission elements to transmit the motion of each driving element to a carrier, wherein each motion system comprises a first force element that is connected on the one hand to a carrier and on the other hand to a fixed point to exert a downward-directed first force on the carrier, and wherein each motion system comprises a second force element and an energy buffer, wherein the first force exerted by the first force element brings about the build-up of a supply of energy in the energy buffer by deformation or displacement of at least one part of an element of the motion system, that each motion system comprises a stopper to prevent the displacement or deformation caused by the first force from exceeding a predetermined maximum, that the second force element is provided to transform the energy stored in the energy buffer into a tensioning force that is exerted on an element of the motion system and results in an upward-directed second force on the carrier, wherein at least one part of the latter element is so deformable or displaceable under the influence of the tensioning force that the elements of the motion system are kept under tension.

2. Shed forming device for a weaving machine according to claim 1, characterized in that each motion system comprises, at least one hook that is movable up and down by a driving element at least one carrier to position one or more warp threads in a shed, and transmission elements to transmit the motion of each hook to at least one carrier.

3. Shed forming device for a weaving machine according to claim 1, characterized in that the second force element is or comprises an energy buffer, and that the first force exerted by the first force element results in a force on the second force element that brings about the build-up of a supply of energy in the energy buffer.

4. Shed forming device for a weaving machine according to claim 1, characterized in that the energy buffer is an accumulator of potential energy, hydraulic energy or pneumatic energy.

5. Shed forming device for a weaving machine according to claim 1, characterized in that at least one element of each motion system is a tensioning element with a first tensioning part and a second tensioning part that are displaceable relative to one another, and that the second force element is provided to exert said tensioning force on at least one of these tensioning parts so that these tensioning parts are forced into a relative position in which the elements of the motion system are kept under tension.

6. Shed forming device for a weaving machine according to claim 5, characterized in that the tensioning parts are integrated into the motion system in such a way that the tensioning parts are forced into a first relative position by the tensioning force so that the elements of the motion system are kept under tension.

7. Shed forming device for a weaving machine according to claim 6, characterized in that the first and the second force element are preferably dimensioned such that the first force exerted by the first force element results in a force on at least one of the tensioning parts that moves these tensioning parts against the tensioning force into a second relative position.

8. Shed forming device for a weaving machine according to claim 7, characterized in that the displacement of the tensioning parts from the first relative position to the second relative position brings about the build-up of a supply of energy in the energy buffer.

9. Shed forming device according to claim 8, characterized in that the second force element comprises a spring element and that the displacement from the first relative position to the second relative position brings about an elastic deformation of the spring element.

10. Shed forming device for a weaving machine according to claim 7, characterized in that each motion system comprises a stopper to prevent the tensioning parts from being displaced by more than a predetermined second relative position under the influence of the first force.

11. Shed forming device for a weaving machine according to claim 5, characterized in that the tensioning element is a cord of the motion system, wherein a first cord section and a second cord section are at a distance from one another, above and below an intermediate cord section, respectively, and that the second force element exerts a tensioning force on one or both cord sections so that the first and the second cord sections are forced towards one another.

12. Shed forming device for a weaving machine according to claim 11, characterized in that the motion system comprises at least one pulley over which a pulley cord runs to transmit the motion of the driving element to the carrier, and that the tensioning element is a pulley cord.

13. Shed forming device for a weaving machine according to claim 11, characterized in that the second force element allows the intermediate cord section to be pulled taut so that this intermediate cord section in the taut state acts as the stopper to prevent the further increase in the distance between said cord sections.

14. Shed forming device for a weaving machine according to claim 5 characterized in that the tensioning element is a connector with two connector parts that form said tensioning parts and that the two connector parts are connected to a respective element of the motion system, or respectively to an element of the motion system and a fixed machine part.

15. Shed forming device for a weaving machine according to claim 14, characterized in that the one connector part comprises a head piece that is located displaceably in a locating space of the other connector part.

16. Shed forming device for a weaving machine according to claim 5, characterized in that each motion system comprises at least one pulley element with two pulleys positioned above one another to transmit the motion of the driving element to at least one carrier, that the pulley element comprises two pulley parts that are displaceable relative to one another so that the pulley element forms the tensioning element and the two pulley parts form said tensioning parts.

17. Shed forming device for a weaving machine according to claim 16, characterized in that an uppermost and a lowermost pulley cord respectively run over the two pulleys positioned above one another that the two ends of the uppermost pulley cord are displaceable by means of a respective driving element that the lowermost pulley cord is connected to one or more harness cords, and that the pulley element acts as a tensioning element in that the pulley element has an uppermost pulley part and a lowermost pulley part at a distance apart wherein the pulley parts are displaceable relative to one another and the second force element exerts a force on these pulley parts to reduce said distance.

18. Shed forming device for a weaving machine according to claim 5 characterized in that the tensioning element is a hook drivable by a driving element with two hook sections that are displaceable relative to one another which form the tensioning parts.

19. Shed forming device for a weaving machine according to claim 5 characterized in that the second force element is a tension spring element that exerts a tractive force on said tensioning parts of the tensioning element to pull these tensioning parts together, or is a pressure spring element that exerts a compressive force on one of said tensioning parts to force this tensioning part in the direction of the other tensioning part.

20. Shed forming device for a weaving machine according to claim 1, characterized in that the second force element is provided to permanently exert a tensioning force.

21. Shed forming device for a weaving machine according to claim 1, characterized in that the second force element is located in the motion system between the carrier and the driving element.

* * * * *